US008890708B2

(12) United States Patent
Savage, Jr.

(10) Patent No.: US 8,890,708 B2
(45) **Date of Patent: *Nov. 18, 2014**

(54) MIXED ELEMENT STROBE

(71) Applicant: Tyco Fire & Security GmbH, Neuhausen am Rheinfall (CH)

(72) Inventor: Kenneth E. Savage, Jr., Fitchburg, MA (US)

(73) Assignee: Tyco Fire & Security GmbH, Neuhausen am Rheinfall (CH)

( * ) Notice: Subject to any disclaimer, the term of this patent is extended or adjusted under 35 U.S.C. 154(b) by 0 days.

This patent is subject to a terminal disclaimer.

(21) Appl. No.: 14/251,322

(22) Filed: Apr. 11, 2014

(65) Prior Publication Data

US 2014/0218204 A1 Aug. 7, 2014

Related U.S. Application Data

(63) Continuation of application No. 13/160,199, filed on Jun. 14, 2011, now Pat. No. 8,723,682.

(51) Int. Cl.
*G08B 3/00* (2006.01)
*G08B 5/38* (2006.01)

(52) U.S. Cl.
CPC ..... *G08B 5/38* (2013.01)
USPC ..... 340/691.8; 340/691.1

(58) Field of Classification Search
CPC combination set(s) only.
See application file for complete search history.

(56) References Cited

U.S. PATENT DOCUMENTS

| | | | | |
|---|---|---|---|---|
| 4,827,245 | A * | 5/1989 | Lipman | 340/321 |
| 6,329,904 | B1 * | 12/2001 | Lamb | 340/286.02 |
| 6,617,964 | B1 * | 9/2003 | Lamb | 340/286.02 |
| 6,731,202 | B1 * | 5/2004 | Klaus | 340/425.5 |
| 6,867,688 | B2 * | 3/2005 | Lamb | 340/286.02 |
| 7,339,467 | B2 * | 3/2008 | Lamb | 340/539.1 |
| 7,872,573 | B2 * | 1/2011 | Lamb | 340/539.1 |
| 8,723,682 | B2 * | 5/2014 | Savage, Jr. | 340/691.8 |
| 2003/0193394 | A1 * | 10/2003 | Lamb | 340/539.28 |
| 2005/0237183 | A1 * | 10/2005 | Lamb | 340/539.11 |
| 2007/0096931 | A1 * | 5/2007 | Runciman et al. | 340/628 |
| 2009/0058665 | A1 * | 3/2009 | Lamb | 340/601 |
| 2012/0319861 | A1 * | 12/2012 | Savage, Jr. | 340/815.45 |

* cited by examiner

*Primary Examiner* — Travis Hunnings
(74) *Attorney, Agent, or Firm* — Brinks Gilson & Lione

(57) ABSTRACT

A strobe device that includes multiple strobe elements is disclosed. The strobe device may include a first strobe element and a second strobe element, where at least one aspect of the first strobe element differs from the second strobe element. For example, the first strobe element may be a Xenon flash tube strobe element and the second strobe element may be an LED-based strobe element. In response to receiving a command to generate an output, the controller determines which of the first strobe element and/or the second strobe element to activate, and sends one or more signals to the first strobe element and/or the second strobe element based on the determination. The controller may activate both of the first strobe element and the second strobe element (such as alternating activation of the first strobe element and the second strobe element). Or, the controller may select one of the first strobe element and the second strobe element. For example, depending on the ambient light at or near the strobe device, the controller may activate either the first strobe element or the second strobe element.

26 Claims, 7 Drawing Sheets

MIXED ELEMENT STROBE

REFERENCE TO RELATED APPLICATION

This application is a continuation of U.S. application Ser. No. 13/160,199, filed on Jun. 14, 2011, the entirety is incorporated by reference herein.

BACKGROUND

Fire alarm devices such as audible horns (audible/visible or A/V), loudspeakers (speaker/visible or S/V) and visible strobes (visible only or V/O), are referred to as "notification appliances." Typically, a fire alarm control panel (FACP) drives these devices over one or more "notification appliance circuits" (NACs). The strobes are used, for example, as an alert for the hearing-impaired, or for those in a high noise environment.

One type of strobe uses a flash tube (also called a flash lamp). Typically, the flash tube is an electric glow discharge lamp designed to produce extremely intense, incoherent, full-spectrum white light for very short durations. Flash tubes are made of a length of glass tubing with electrodes at either end and are filled with a gas that, when triggered, ionizes and conducts a high voltage pulse to produce the light. Xenon is an example of the gas that can fill the flash tube, with a Xenon flash tube producing a high-intensity light (such as hundreds of thousands of lumens) for a very short duration pulse (such as hundreds of milliseconds).

The lifetime of the flash tube can depend on both the energy level used for the lamp in proportion to its discharge energy, and on the pulse duration of the lamp. Failures can be catastrophic, causing the lamp to shatter, or they can be gradual, reducing the performance of the lamp below a usable rating.

Another type of strobe is Light Emitting Diode (LED)-based. An LED-based strobe cannot generate light at as high of an intensity as a Xenon-based strobe. Instead, LED-based strobes generate a lower intensity light (such as hundreds of lumens) for a longer period of time (such as tens to hundreds of milliseconds). In this way, the LED-based strobes can generate a comparable amount of light energy, as measured in candela, as a Xenon-based strobe. In contrast to flash-tube based strobes, LED-based strobes typically have a longer usable lifetime.

SUMMARY

The present embodiments relate to a strobe notification device that includes at least a first strobe element and a second strobe element, with at least one aspect of the first strobe element being different from the second strobe element. The first and second strobe elements may be different types of strobe elements, including for example: a gas flash tube strobe element and a non gas flash tube strobe element; a xenon flash tube strobe element and a non xenon flash tube strobe element; a higher-intensity strobe element and a lower-intensity strobe element; a shorter output pulse strobe element and a longer output pulse strobe element; a semiconductor strobe element and a non-semiconductor strobe element; and/or an LED strobe element and a non-LED strobe element.

The strobe notification device may generate an output in response to receipt of a command, the command indicative of commanding the strobe notification device to generate an output. In response to receipt of the command to generate an output, the strobe notification device may determine which of the strobe elements to activate, and in response to the determination, activate the first strobe element, the second strobe element, and/or both the first strobe element and the second strobe element. The determination may be based on reading a memory within the strobe notification device (which may be indicative of which (or both) of the strobe elements to activate) or may be based on a switch on the strobe notification device (which may be configurable by an operator to indicate which (or both) of the strobe elements to activate). For example, a controller of the strobe notification device may activate both the first strobe element and the second strobe element, such as the controller sending commands to each of the first strobe element and the second strobe element in order to alternate activation of the first strobe element and the second strobe element.

As another example, the controller of the strobe notification device may select only one of the first strobe element and the second strobe element, and in response to the selection, activate the selected strobe element. The controller may receive an input external to the strobe in order for the controller to make the selection. The strobe notification device may be an addressable strobe notification device (e.g., the strobe notification device has a uniquely assigned address) or a non-addressable strobe notification device.

In one aspect, the input may be based on an environmental condition external to the strobe (such as the ambient light proximate to or near the strobe notification device). For example, the strobe notification device may optionally include a sensor to sense the ambient light proximate to the strobe notification device. The sensor may generate an indication of the amount of ambient light and provide this indication as an input to the controller. In response to receiving the indication of the amount of ambient light, may select one of the strobe elements.

Dark ambient research data indicates a higher perceived brightness with longer pulse durations. In bright ambient, the shorter, high intensity pulse may be more noticeable. Given this, in dark ambient, an LED-based strobe element may be a more effective strobe output than a flash-tube based strobe element. Moreover, in bright ambient, a flash-tube based strobe element may be a more effective strobe output than an LED-based strobe element. Ambient light for a given strobe installation may vary, and can be either bright or dark depending on the time of day or location. The controller may receive the amount indicative of ambient light from the sensor, such as sensing the amount of light in real-time after receipt of the command to generate an output, and select one of the strobe elements based on the sensed amount of ambient light. In one example, a single predetermined level determines which of the first strobe element and the second strobe element to select. If the amount indicative of ambient light is greater than the predetermined amount, the flash-tube based strobe element is selected. If the amount indicative of ambient light is less than the predetermined amount, the LED based strobe element is selected. In a second example, multiple predetermined levels determine which of the first strobe element and the second strobe element to select. If the amount indicative of ambient light is greater than a first predetermined amount, the flash-tube based strobe element is selected. If the amount indicative of ambient light is less than a second predetermined amount, the LED based strobe element is selected. If the amount indicative of ambient light is less than the first predetermined amount and greater than the second predetermined amount, both the flash-tube based strobe element and the LED based strobe element are selected.

In another aspect, the input may be based on a message sent from a device external to the strobe device, such as a fire alarm controller. The message may be a part of the command received by the strobe device to generate an output. For example, the message may be a field within the command. The field may indicate which of the first strobe element or the second strobe element, or both, is to be activated. The strobe device may then select the strobe element(s) to activate as indicated in the message.

Other systems, methods, features and advantages will be, or will become, apparent to one with skill in the art upon examination of the following figures and detailed description. It is intended that all such additional systems, methods, features and advantages be included within this description, be within the scope of the invention, and be protected by the following claims.

DETAILED DESCRIPTION

Figure 1:
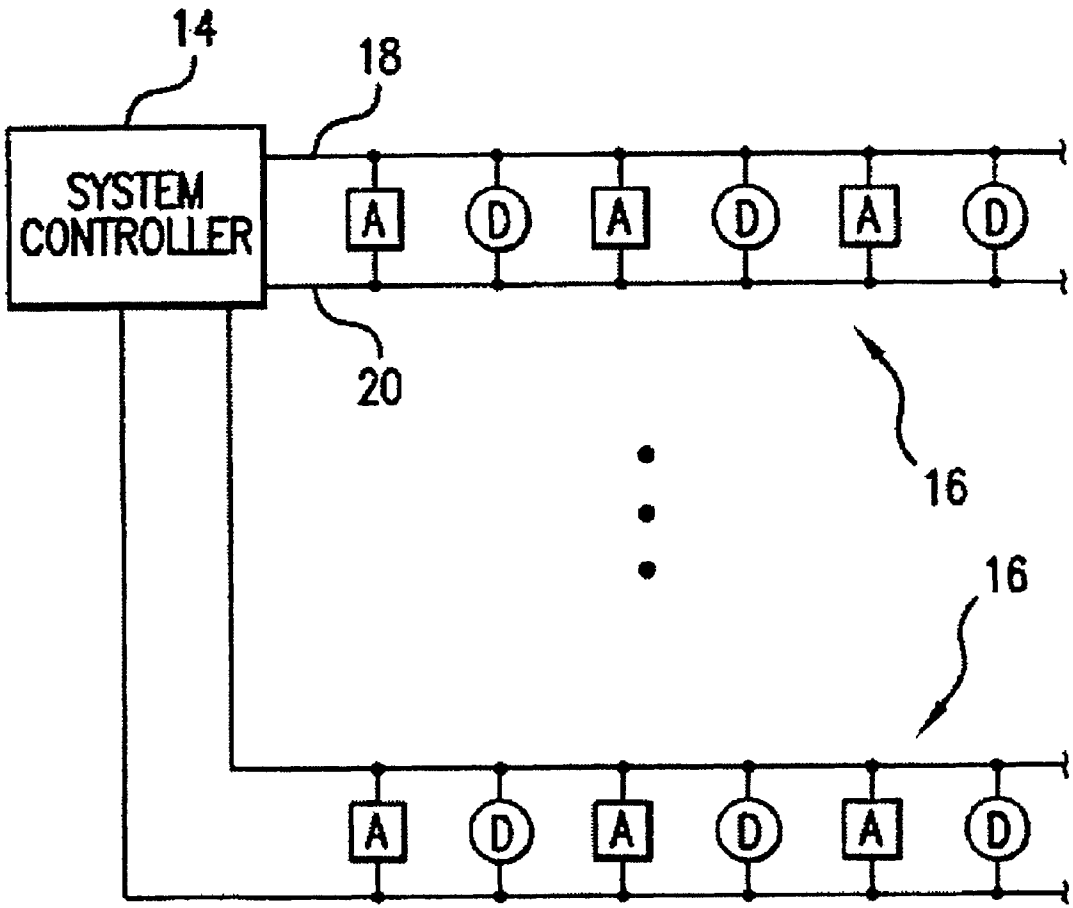
FIG. 1 is a schematic diagram illustrating a fire alarm system.

A system embodying one example of the present invention is illustrated in FIG. 1. The system includes one or more notification appliance circuits (NACs), i.e., networks 16, having alarm condition detectors D and alarm system notification device A. Alternatively, the detectors and notification devices may be on separate networks. A system controller (such as a fire alarm control panel (FACP)) 14 may monitor the detectors D.

The system controller 14 may monitor the alarm condition detectors D. When an alarm condition is sensed, the system controller 14 may signal the alarm to the appropriate notification appliances A through the one or more appliance circuits. Notification devices may include, for example, a visual alarm (such as a strobe), an audible alarm (such as a horn), or a combination thereof.

Although not necessary for carrying out the invention, as shown, all of the notification devices in a network are coupled across a pair of power lines 18 and 20 that advantageously also optionally (in the case of an addressable notification appliance system) carry communications between the system controller 14 and the detectors D and notification devices A.

The system controller 14 may comprise a fire alarm control panel and may use one or more commands to signal the alarm to the appropriate notification appliances A. Examples of commands issued for a system with addressable notification appliances are disclosed in U.S. Pat. No. 6,426,697, which is hereby incorporated by reference in its entirety. Alternatively, the communication line to the device may be separate from the power line. In still an alternative embodiment, the system may include non-addressable notification appliances. The communications channel may comprise, for example, a wireless link, a wired link or a fiber optic link.

Further, the system controller 14 may send optionally one or more commands relating to diagnostics, status, or other non-alarm type events. For example the system controller 14 may send a command related to the identification, the configuration, and/or the status of the notification appliances A. Moreover, the notification appliances A may respond in kind.

One, some, or all of the notification devices A may comprise a strobe device that includes multiple strobe elements, such as a first strobe element and a second strobe element. In one embodiment, the first strobe element is different from the second strobe element. As discussed in more detail below, the first and second strobe elements may be different types of strobe elements. Examples of different types of strobe elements include, without limitation: a gas flash tube strobe element and a non gas flash tube strobe element; a xenon flash tube strobe element and a non xenon flash tube strobe element; a higher-intensity strobe element and a lower-intensity strobe element; a shorter output pulse element and a longer output pulse element; a semiconductor strobe element and a non-semiconductor strobe element; and/or an LED strobe element and a non-LED strobe element.

As discussed in more detail below, the fire alarm control panel may send a command to one or more strobe to active one or more strobe elements associated with the strobe.

Figure 2:
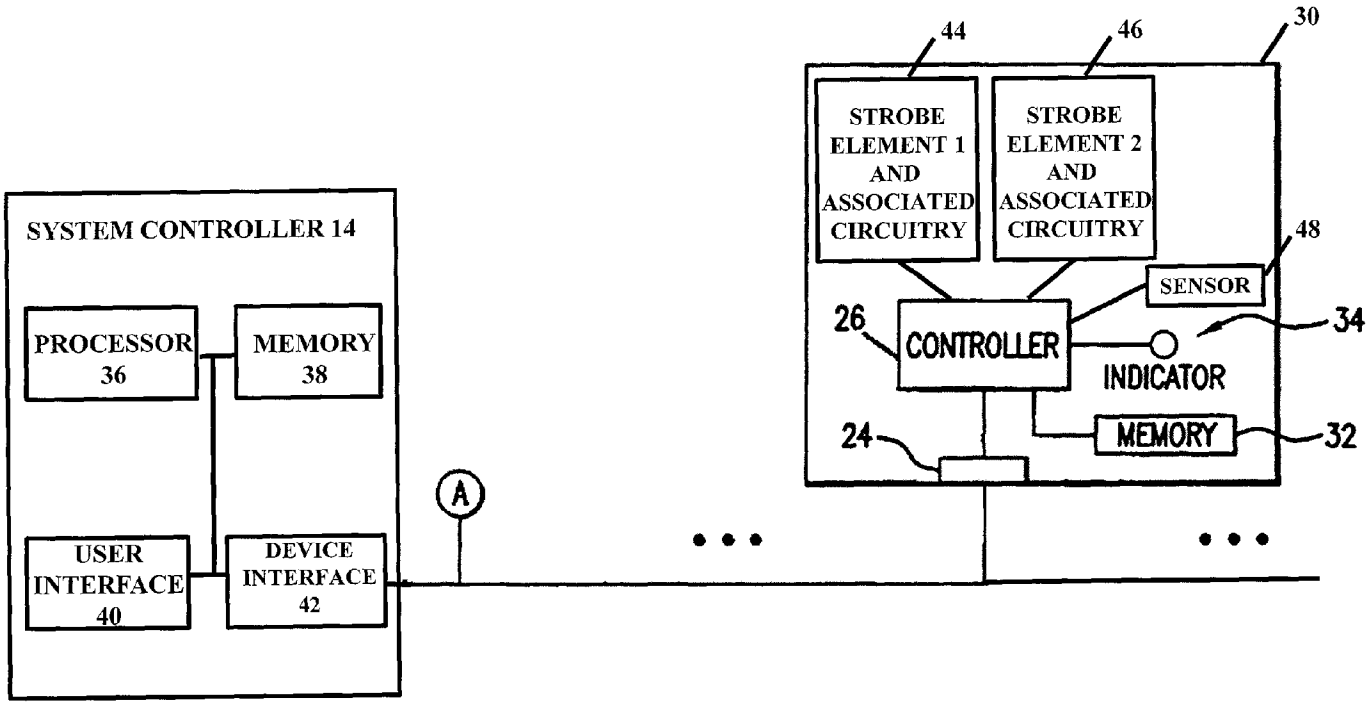
FIG. 2 is a schematic diagram of the system of FIG. 1, further illustrating details of a system controller and a strobe device.

FIG. 2 is a schematic diagram of a part of the system shown in FIG. 1, further illustrating details of the system controller 14 and one of the notification appliances. The system controller 14 includes a processor 36, a memory 38, a user interface 40, and a device interface 42. The processor 36 may comprise a microprocessor, a microcontroller, a digital signal processor, an application specific integrated circuit (ASIC), a field programmable gate array, a logical digital circuit, or other now known or later developed logical processing capability. The processor 36 may work in combination with the memory 38 in order to monitor part or all of the fire alarm system, including one or more of the appliance circuits (such as one or more notification appliance circuits, one or more detector circuits, and/or one or more notification appliance/detector circuits). In addition, the memory may include one or more look-up tables (or other data structures) used for configuration.

User interface 40 may be used by an operator to control configuration and/or operation of the alarm condition detectors D and alarm system notification appliances A. And, device interface 42 may be an example of a communications interface, and may comprise the interface between the system controller 14 and the alarm condition detectors D and alarm system notification appliances A in the one or more appliance circuits.

FIG. 2 further depicts a strobe device 30 in greater detail. The strobe device 30 connects to the network 16 via a network interface (communication connection) 24. The strobe device 30 receives one or more commands from the system controller 14. The controller 26 processes the one or more commands, as discussed in more detail below. Although shown separately, the memory 32 may be integrated with the controller 26.

The strobe device 30 further includes strobe element 1 and associated circuitry 44 and strobe element 2 and associated circuitry 46. In one example, strobe element 1 is a Xenon-based strobe element and strobe element 2 is an LED-based strobe element. In one embodiment, the controller 26 determines which (or both) of strobe element 1 or strobe element 2 to activate, and sends commands to activate the strobe elements based on the determination. In one embodiment, the strobe element 2 may send a command to activate one (or both) of the strobe elements by activating a single signal line (such as by sending a high signal, a low signal, or a pulse signal on the single signal line).

Figure 5:
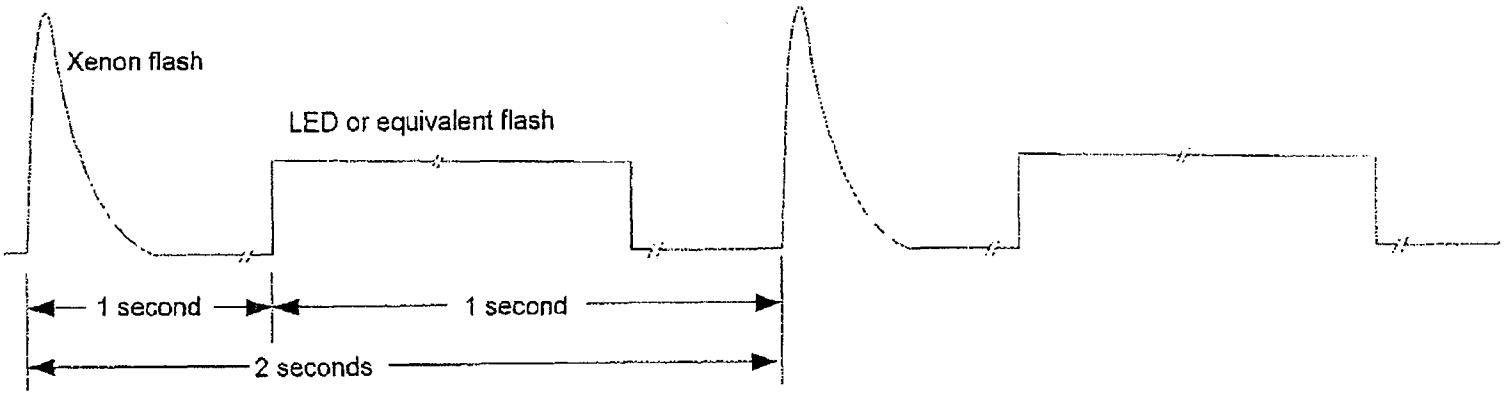
FIG. 5 is an exemplary output of the strobe device, including alternating outputs for strobe element 1 and strobe element 2.

In one aspect, the strobe device 30 is pre-programmed to activate both strobe elements, such as alternating between activating strobe element 1 and strobe element 2. An example of this is depicted in FIG. 5, discussed below. Alternating the activation of the different strobe elements (such as Xenon and an LED (or equivalent) light source) may improve notification in different ambient lighting conditions.

The pre-programming of the strobe device 30 may be performed at manufacture of the strobe device 30 and stored in memory 32. Or, the pre-programming of the strobe device 30 may be performed prior to receipt of the command to activate the strobe device (such as during installation/configuration of the fire alarm system). For example, the system controller 14 may send a configuration command to the strobe device to pre-program the strobe device 30. As another example, a technician may input the configuration command via an input device (not shown), local to the strobe device 30.

In another aspect, the strobe device 30 may determine which (or both) of the strobe elements to activate. The determination which of the strobe elements to activate may be based on a static condition. One example of a static condition is pre-programming of which (or both) of the strobe elements to activate. The programming may be manifested in a memory (such as memory 32 or an internal memory to controller 26), which the controller 26 may access when determining which of the strobe elements to activate. Alternatively, the programming may be manifested in a switch (not shown). The switch may be operator configurable to a position to indicate which (or both) of the strobe elements to activate.

In another embodiment, the determination which of the strobe elements to activate may be based on a dynamic or changing condition. One example of a dynamic or changing condition is ambient lighting. The strobe device 30 may optionally receive an indication of the ambient lighting via sensor 48. The sensor 48 may include a photosensor or photodetector that detects light in a predetermined wavelength range, such as the visible light range. As discussed in more detail below, the sensor 48 may sense the amount of ambient light prior to the controller determining which of the strobe elements to activate. For example, the sensor 48 may sense the amount of ambient light at predetermined times (such as once per hour) and store a value indicative of the amount of ambient light in memory 32. As another example, the sensor 48 may sense the amount of ambient light in response to the strobe device 30 receiving a command to activate one of the strobe elements. Alternatively, the strobe device 30 does not include a sensor to sense an indication of ambient light.

The controller 26 may receive the amount indicative of ambient light from the sensor 48. The controller 26 may then select one of the strobe elements based on the sensed amount of ambient light. In one example, the controller 26 compares the amount indicative of ambient light to a single predetermined level. If the amount indicative of ambient light is greater than the predetermined amount, the flash-tube based strobe element is selected. If the amount indicative of ambient light is less than or equal the predetermined amount, the LED based strobe element is selected. Alternatively, the controller may comprise analog circuitry with the amount indicative of ambient light may be input to the analog circuitry. The predetermined amount may be set by an input device, such as a switch or a jumper setting, which may be located on the strobe device 30.

In a second example, the controller 26 compares the amount indicative of ambient light to multiple predetermined levels in order to determine which of the first strobe element and the second strobe element to select. If the amount indicative of ambient light is greater than a first predetermined amount, the flash-tube based strobe element is selected. If the amount indicative of ambient light is less than a second predetermined amount, the LED based strobe element is selected. If the amount indicative of ambient light is less than the first predetermined amount and greater than the second predetermined amount, both the flash-tube based strobe element and the LED based strobe element are selected.

After the controller 26 determines which (or both) of the first strobe element and the second strobe element to activate, the controller sends one or more control signals in order to control the activation (including controlling activation of the first strobe element and/or the second strobe element at the proper times). One example of a flash tube strobe element is disclosed in U.S. Pat. No. 7,456,585, herein incorporated by reference in its entirety. One example of an LED-based strobe element is disclosed in U.S. Patent Application No. 2008/0272911, herein incorporated by reference in its entirety.

In an office environment, the minimum illuminance may be approximately 300 lux. In a home environment (such as a living room), the ambient light level may be a minimum illuminance of 100 lux. The sensor 48 may output a voltage value for a given amount of light. The voltage value may then be sent to a group of discrete level detectors or may be input to an A to D converter. The levels from the sensor may then be used activate the appropriate strobe element. For example, a strobe element with a lower intensity flash (such as an LED-based strobe element) may used below 100 lux. A combination of both strobe element flashes may be used between 100 and 300 lux. Further, a high intensity flash (such as an Xenon-based strobe element) may be used at 300 lux and above In some embodiments, an indicator 34, such as a flashing LED, may be used as an output, for example during diagnostic testing, on the strobe device 30. The indicator 34 may be activated, for example, upon command from the system controller 14, upon a local manual command such as a pushbutton (not shown).

Figure 3:
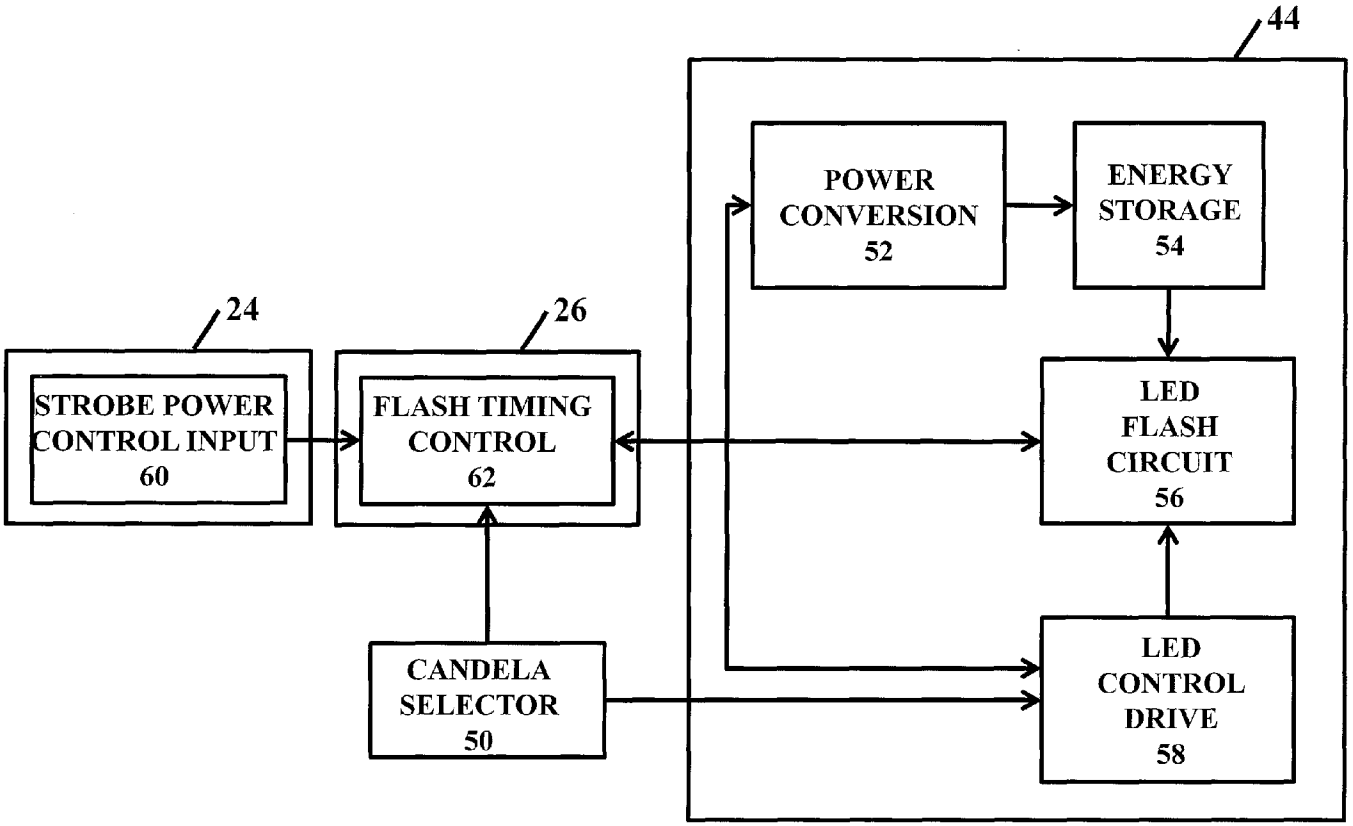
FIG. 3 illustrates an expanded block diagram of the strobe device (including strobe element 1 and associated circuitry) illustrated in FIG. 2.

Referring to FIG. 3, there is shown an expanded block diagram of the strobe device (including strobe element 1 and associated circuitry 44) illustrated in FIG. 2. The network interface 24 includes a strobe power control input 60 that receives the command to activate the strobe device 30 and power the strobe device 30. The strobe power control input sends the received command to the controller 26. The controller 26 includes flash timing control 62, which controls the timing of the flashes of one (or both) of the strobe elements. The flash timing control 62 may receive as an input the candela selector 50, which may be an input device on the strobe device 30 (such as a multi-position switch). An example of the switch is disclosed in U.S. Pat. No. 7,456,585, incorporated by reference herein in its entirety. Examples of candela settings include 15, 30, 75, and 110. Alternatively, the candela setting may be pre-programmed and stored in memory 32. Based on the candela setting, the flash timing control 62 may control strobe element 1 and associated circuitry 44 and strobe element 2 and associated circuitry 46 to generate an output with the desired candela setting. One example of the strobe element 1 and associated circuitry 44 is illustrated in FIG. 3, including an LED flash circuit 56, a power conversion circuit 52, energy storage circuit 54, and LED control drive 58. The power conversion circuit 52 provides the proper regulated voltage to the energy storage circuit 54. An example of the power conversion circuit 52 may be a voltage regulator (such as a DC-DC Converter or a current regulator), and an example of the energy storage circuit 54 may be a capacitor. The flash timing control circuit 62 generates an output to the LED control drive 58. Based on the output, the LED control drive 58 provides the proper current to the LED flash circuit 56 in order for the LED flash circuit 56 to generate the desired intensity. Further, the flash timing control 62 generates an output to LED flash circuit 56, which dictates the duration of the output of the LED flash circuit 56. Thus, the flash timing control 62 controls both the intensity and the duration in order generate an output with the requested candela rating (as dictated by candela selector 50). The flash timing control 62 further communicates with the power conversion circuit 52 in order for the power conversion circuit 52 to provide the proper voltage to energy storage circuit 54.

Figure 4:
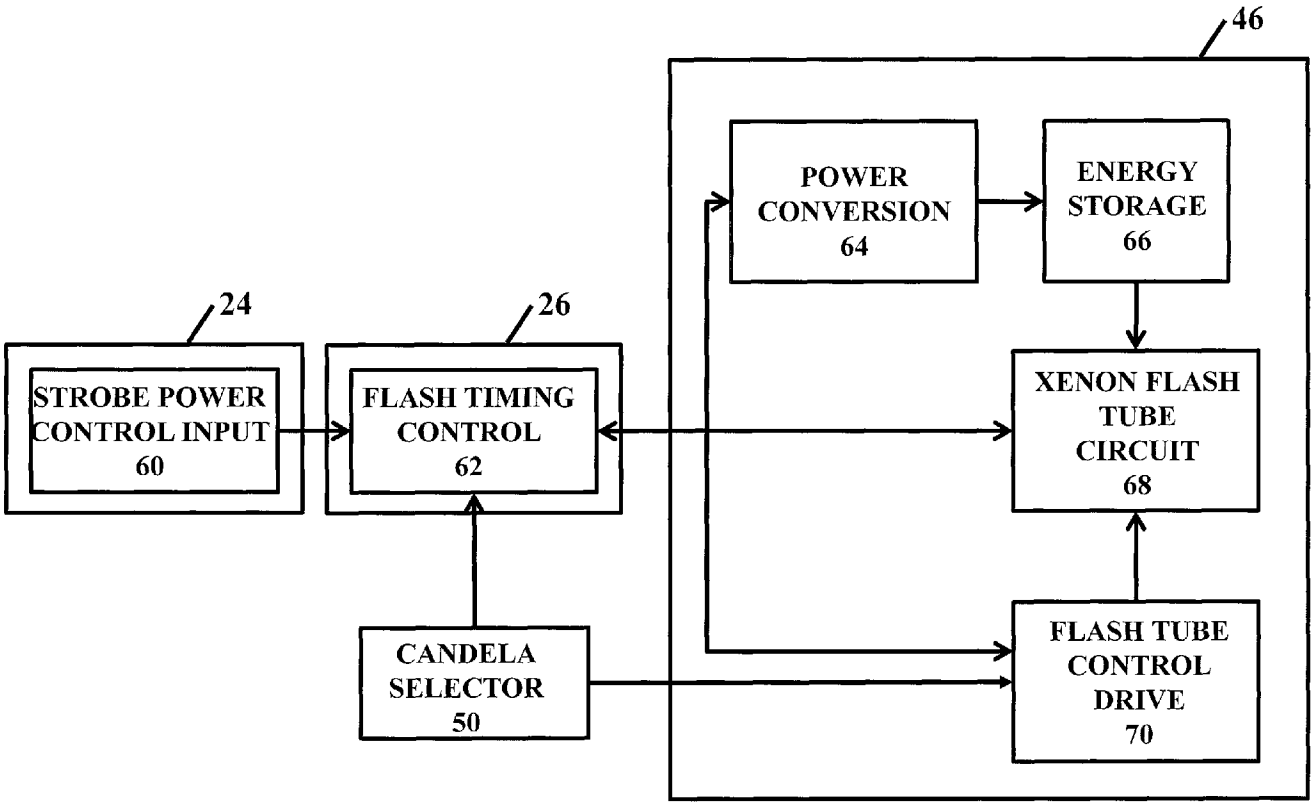
FIG. 4 illustrates an expanded block diagram of the strobe device (including strobe element 2 and associated circuitry) illustrated in FIG. 2.

Referring to FIG. 4, there is shown another expanded block diagram of the strobe device (including strobe element 2 and associated circuitry 46) illustrated in FIG. 2. Similar to FIG. 3, FIG. 4 illustrates the network interface 24 that includes a strobe power control input 60, flash timing control 62 of controller 26, and candela selector 50. One example of the strobe element 2 and associated circuitry 46 is illustrated in FIG. 4, including a Xenon flash tube circuit 68, a power conversion circuit 64, energy storage circuit 66, and flash tube control drive 70. The power conversion circuit 64 provides the proper regulated voltage to the energy storage circuit 66. An example of the power conversion circuit 64 may be a voltage regulator (such as a DC-DC Converter or a current regulator), and an example of the energy storage circuit 66 may be a capacitor. The flash tube control drive 70 provides the proper voltage and current control in order for the Xenon flash tube circuit 68 to generate an output at the requested candela rating (as dictated by candela selector 50). Further, flash timing control 62 communicates with power conversion circuit 64, Xenon flash tube circuit 68, and flash tube control drive 70 in order to control the activation of Xenon flash tube circuit 68 at the appointed times (such as illustrated in FIG. 5).

FIG. 5 illustrates an example of the pattern of light output for the strobe device 30. As shown in FIG. 5, the light alternates between a Xenon flash and an LED (or equivalent) flash. The Xenon flash and the LED (or equivalent) flash are each approximately once per second (so that the cycle is a total of 2 seconds). The cycle may repeat a predetermined number of times, may repeat for a predetermined amount of time, or may repeat until the strobe device 30 receives a command from the system controller 14 to end output. As shown in FIG. 5, the Xenon-based strobe element generates the first output flash, and then the LED-based strobe element generates the second output flash. Alternatively, the LED-based strobe element may generate the first output flash and the Xenon-based strobe element generates the second output flash (with this cycle repeating). Further, FIG. 5 illustrates that there is one Xenon flash and one LED (or equivalent flash) per cycle. Alternatively, the ratio of flashes for strobe element 1 and strobe element 2 need not be 1:1. For example, the number of Xenon flashes may be greater or less than the number of LED flashes per cycle (such as 2:1 or 1:2). As another example, the Xenon flash may at least partly overlap in time with the LED flash.

Figure 6:
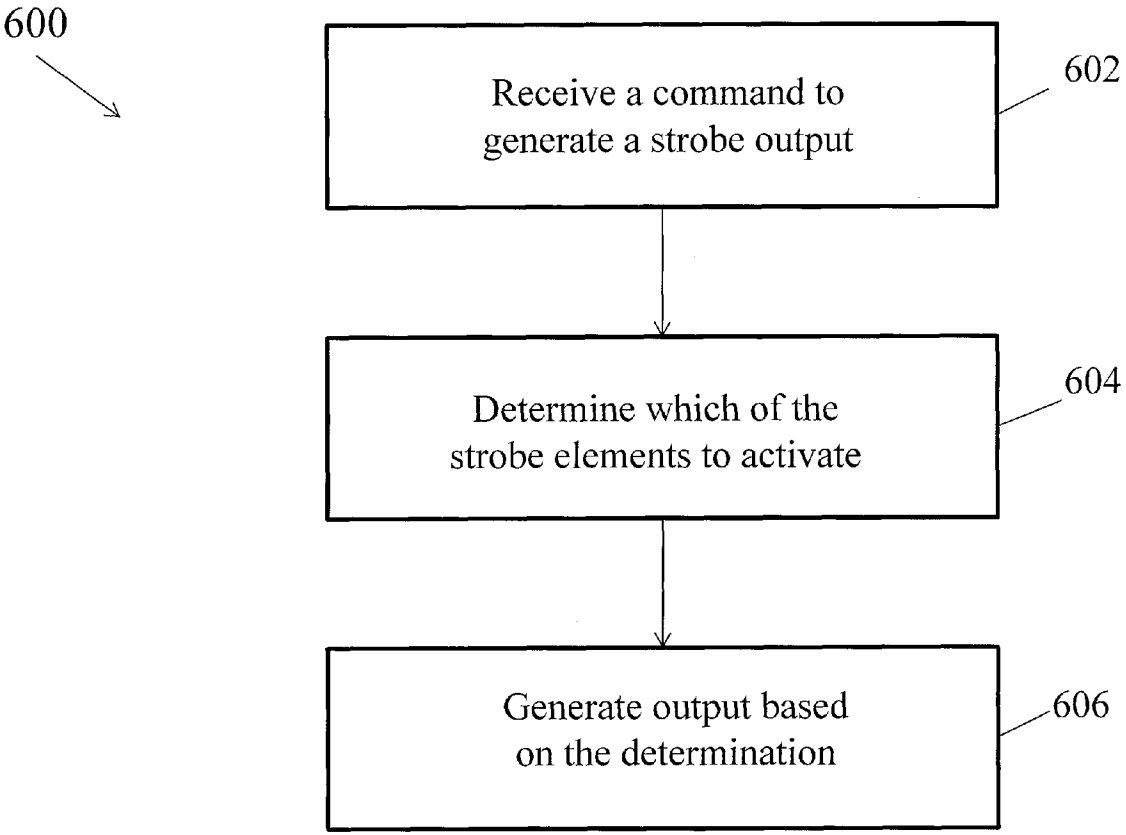
FIG. 6 is an exemplary flow chart of operation of the strobe device.

Referring to FIG. 6, there is illustrated a flow chart 600 for operating the strobe device. At block 602, the strobe device receives a command to generate a strobe output. At block 604, the strobe device determines which of the strobe elements to activate. As discussed above, the controller 26 may determine whether to activate strobe element 1, strobe element 2, or both strobe element 1 and strobe element 2. In one embodiment, the strobe device is pre-programmed to activate both strobe element 1 and strobe element 2, so that the determination includes accessing a memory location that stores the pre-programmed pattern of output. In an alternative embodiment, the strobe element receives an indication from an external device (such as the system controller 14) of which (or both) of the strobe elements to activate. The indication may be included in the command to generate the strobe output. The strobe device may review the command in the strobe device determining which of the strobe elements to activate. In still another embodiment, the strobe device may obtain a sensor reading, such as a reading of an ambient light level. As discussed in more detail in FIG. 7, the strobe device may determine which (or both) of the strobe elements to activate based on the sensor reading. As shown at block 606, the controller sends one or more control signals in order to generate the output based on the determination.

Figure 7:
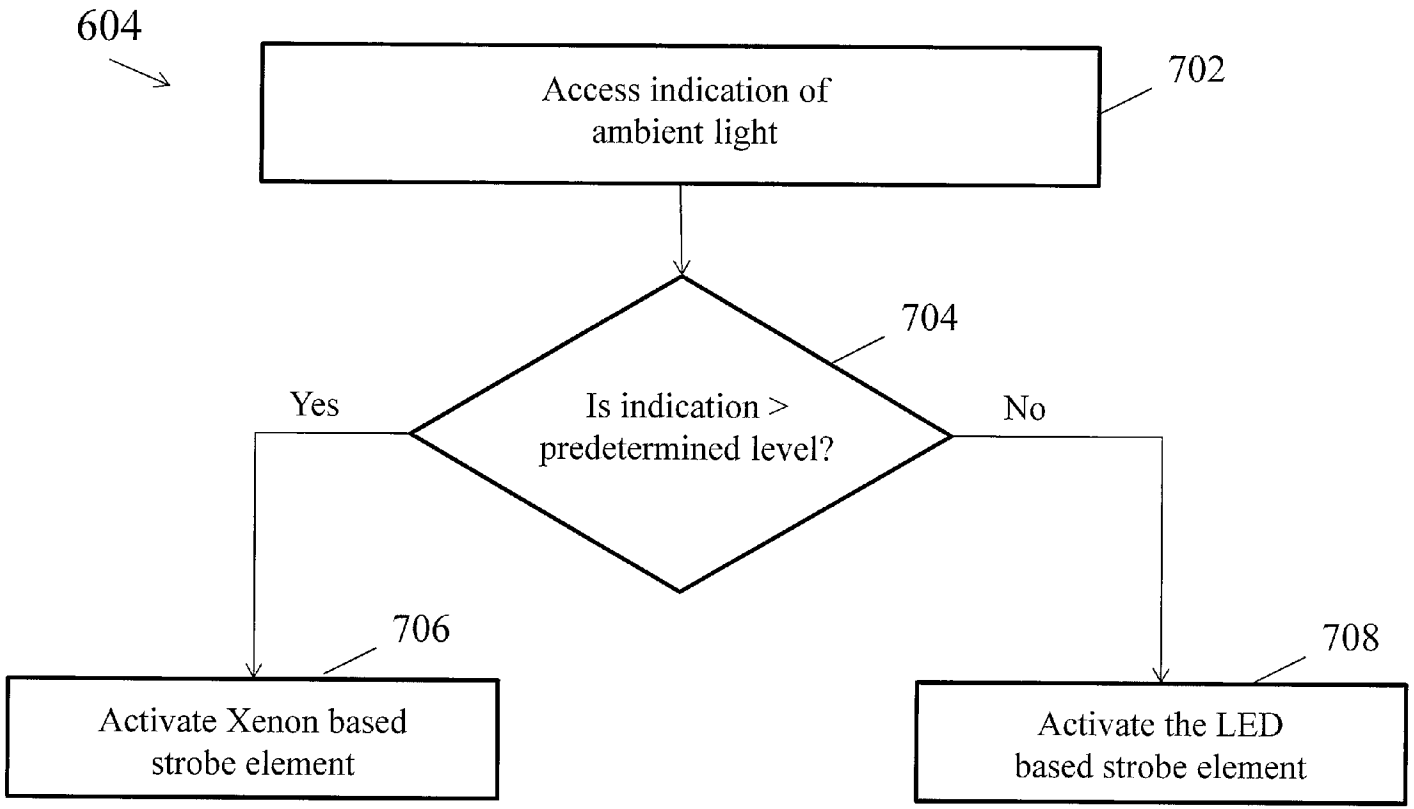
FIG. 7 is an exemplary flow chart of determining which of the strobe elements to activate.

Referring to FIG. 7, there is shown a flow chart of one example of the determination of which strobe element to activate (block 604 in FIG. 6). At block 702, an indication of the ambient light is accessed. The indication of the ambient light may be stored in a memory, such as memory 32, based on a sensor reading from sensor 48 taken prior to receipt of the command to activate the strobe device. Alternatively, a real-time sensor reading from sensor 48 may be taken in response to receipt of the command to activate the strobe device. The indication of the ambient light is compared to at least one predetermined level, as shown at 704. In one aspect, only a single predetermined level is used (as illustrated in FIG. 7). Alternatively, multiple predetermined levels may be used, as discussed above. If the indication of the amount of ambient light is greater than the predetermined level, the Xenon based strobe element is activated, as shown at 606. If the indication of the amount of ambient light is less than or equal to the predetermined level, the LED-based strobe element is activated, as shown at 608.

While the invention has been described with reference to various embodiments, it should be understood that many changes and modifications can be made without departing from the scope of the invention. It is therefore intended that the foregoing detailed description be regarded as illustrative rather than limiting, and that it be understood that it is the following claims, including all equivalents, that are intended to define the spirit and scope of this invention.

The invention claimed is:

1. A strobe notification device comprising:

a first strobe element;

a second strobe element, wherein the second strobe element is configured to output light at an intensity lower than light output from the first strobe element; and a controller in communication with the first strobe element and the second strobe element, the controller configured to:

receive a command to activate the strobe notification device;

determine which of the first strobe element and the second strobe element to activate; and in response to the determination, send at least one signal to at least one of the first strobe element and the second strobe element based on the determination.

2. The strobe notification device of claim 1, wherein the first strobe element is a gas flash tube strobe element; and wherein the second strobe element is a non gas flash tube strobe element.

3. The strobe notification device of claim 1, wherein the controller is configured to determine to activate only one of the first strobe element or the second strobe element.

4. The strobe notification device of claim 1, wherein the controller is configured to determine to activate both of the first strobe element and the second strobe element.

5. The strobe notification device of claim 4, wherein in response to the determination to activate both of the first strobe element and the second strobe element, the controller is configured to send signals to the first strobe element and the second strobe element in order to alternate activation of the first strobe element and the second strobe element.

6. The strobe notification device of claim 5, wherein the controller is configured to alternate activation of the first strobe element and the second strobe element so that a ratio of flashes from the first strobe element and the second strobe element is 1:1.

7. The strobe notification device of claim 5, wherein the controller is configured to alternate activation of the first strobe element and the second strobe element so that a ratio of flashes from the first strobe element and the second strobe element is not 1:1.

8. The strobe notification device of claim 5, wherein the controller is configured to alternate activation of the first strobe element and the second strobe element for a predetermined amount of time or a predetermined number of flashes of the first strobe element and the second strobe element.

9. The strobe notification device of claim 5, wherein the controller is configured to alternate activation of the first strobe element and the second strobe element until the controller receives an end output command indicative of stopping activation of the first strobe element and the second strobe element.

10. The strobe notification device of claim 4, wherein the controller is configured to activate both of the first strobe element and the second strobe element such that the light output from the first strobe element at least partly overlaps in time the light output from the second strobe element.

11. The strobe notification device of claim 1, wherein the controller is configured to operate the second strobe element at a longer duration than the first strobe element.

12. The strobe notification device of claim 1, wherein the strobe notification device is configured to receive an input indicative to the controller to activate one or both of the first strobe element or the second strobe element.

13. The strobe notification device of claim 12, further comprising an operator selectable input element configured to receive the input.

14. The strobe notification device of claim 13, wherein the operator selectable input element comprises a manually configurable switch.

15. The strobe notification device of claim 12, further comprising a communication interface configured to receive the input from a fire alarm panel.

16. A method for determining which of a first strobe element or a second strobe element within a multi-strobe element notification device to activate, the method comprising:

receiving a command to activate the notification device;

determining which of the first strobe element or second strobe element to activate; and in response to the determination, sending at least one signal to at least one of the first strobe element and the second strobe element based on the determination, wherein the second strobe element is configured to output light at an intensity lower than light output from the first strobe element.

17. The method of claim 16, wherein determining which of the first strobe element or second strobe element to activate comprises determining to activate both of the first strobe element and the second strobe element.

18. The method of claim 17, wherein in response to determining to activate both of the first strobe element and the second strobe element, sending signals to the first strobe element and the second strobe element in order to alternate activation of the first strobe element and the second strobe element.

19. The method of claim 18, wherein alternating activation of the first strobe element and the second strobe element is such that a ratio of flashes from the first strobe element and the second strobe element is 1:1.

20. The method of claim 18, wherein alternating activation of the first strobe element and the second strobe element is such that a ratio of flashes from the first strobe element and the second strobe element is not 1:1.

21. The method of claim 18, wherein alternating activation of the first strobe element and the second strobe element is for a predetermined amount of time or a predetermined number of flashes of the first strobe element and the second strobe element.

22. The method of claim 18, wherein alternating activation of the first strobe element and the second strobe element is until an end output command is received, the end output command indicative of stopping activation of the first strobe element and the second strobe element.

23. The method of claim 17, wherein activating both of the first strobe element and the second strobe element is such that the light output from the first strobe element at least partly overlaps in time the light output from the second strobe element.

24. The method of claim 16, further comprising receiving an input indicative of activating one or both of the first strobe element or the second strobe element.

25. The method of claim 24, wherein the input is received via an operator selectable input element.

26. The method of claim 24, wherein the multi-strobe element notification device comprises a communication interface; and wherein the input is received from a fire alarm control panel via the communication interface.

* * * * *